US009970271B2

(12) United States Patent
Crane

(10) Patent No.: US 9,970,271 B2
(45) Date of Patent: May 15, 2018

(54) PLUNGER APPARATUS

(71) Applicant: Don Crane, Snyder, TX (US)

(72) Inventor: Don Crane, Snyder, TX (US)

( * ) Notice: Subject to any disclaimer, the term of this patent is extended or adjusted under 35 U.S.C. 154(b) by 346 days.

(21) Appl. No.: 14/803,823

(22) Filed: Jul. 20, 2015

(65) Prior Publication Data

US 2017/0022987 A1 Jan. 26, 2017

(51) Int. Cl.

*E21B 43/12* (2006.01)
*F04B 53/14* (2006.01)
*F04B 47/02* (2006.01)

(52) U.S. Cl.

CPC ..... *E21B 43/127* (2013.01); *F04B 47/02* (2013.01); *F04B 53/14* (2013.01)

(58) Field of Classification Search

CPC .... E21B 43/127; E21B 43/126; E21B 43/121; F04B 19/04; F04B 47/02; F04B 47/026; F04B 47/022; F04B 47/12; F04B 53/14
See application file for complete search history.

(56) References Cited

U.S. PATENT DOCUMENTS 3,367,279 A * 2/1968 Crowe ..... E21B 43/12 417/554
3,822,970 A * 7/1974 Smith ..... F04B 47/02 417/552
4,848,454 A * 7/1989 Spears ..... E21B 31/107 166/108
6,755,628 B1 * 6/2004 Howell ..... E21B 43/127 166/105
7,404,702 B2 * 7/2008 Ford ..... F04B 47/005 166/105.1
7,428,923 B2 9/2008 Ford
8,448,710 B1 * 5/2013 Stephens ..... E21B 43/121 166/105
8,535,024 B2 9/2013 Conyers et al.
D700,622 S 3/2014 Carruth et al.
D724,104 S * 3/2015 Carruth ..... D15/7
9,341,183 B1 * 5/2016 Carruth ..... F04B 47/005
2005/0025644 A1 * 2/2005 Ford ..... F04B 47/005 417/430
2007/0151738 A1 * 7/2007 Giacomino ..... E21B 34/14 166/372
2010/0215528 A1 * 8/2010 Fisher ..... E21B 33/038 417/456
2012/0211237 A1 * 8/2012 Rich ..... F04B 19/04 166/369
2013/0327528 A1 * 12/2013 Frost ..... E21B 37/06 166/304
2013/0336821 A1 12/2013 Rich
(Continued)

*Primary Examiner* — Jennifer H Gay
(74) *Attorney, Agent, or Firm* — Kirby B Drake; Klemchuk LLP

(57) ABSTRACT

A plunger apparatus may include an upper cylindrical section, a plurality of through-holes, an elongated body, and a lower cylindrical section. The plurality of through-holes may be circumferentially arranged about the upper cylindrical section to provide passages for venting and releasing particulates that clog the plunger and barrel seal area. Further, the plunger apparatus may provide an undersized area circumferentially disposed about the upper cylindrical section for creating a point of relief and inducing swirling of particulates. An oversized area may also be provided for creating a point of increased pressure about the plunger apparatus.

11 Claims, 8 Drawing Sheets

(56) References Cited

U.S. PATENT DOCUMENTS

| | | | | |
|---|---|---|---|---|
| 2014/0131993 | A1* | 5/2014 | Rubio, Jr. | E21B 33/1208 285/45 |
| 2016/0237796 | A1* | 8/2016 | Stachowiak | F04B 47/02 |
| 2017/0022987 | A1* | 1/2017 | Crane | F04B 53/14 |
| 2017/0058651 | A1* | 3/2017 | Damiano | F04B 47/12 |
| 2017/0107802 | A1* | 4/2017 | Kuykendall | E21B 43/12 |

* cited by examiner

PLUNGER APPARATUS

TECHNICAL FIELD

The present subject matter relates to downhole rod pumps, and more particularly to downhole reciprocating rod pump plungers.

BACKGROUND

While traveling through an oil well pump system, particulates, such as sand and fines, become entrained with oil and forced out of a rod pump plunger. These particulates are known to settle around the plunger and barrel seal area, thereby resulting in cutting, sticking, and galling of the plunger and barrel seal area. Particulates that settle around the plunger are also known to cause rod pump valves to detrimentally remain open or closed. As such, the upper end of the plunger is a critical component used to prevent particulates from causing failure in a rod pump system. Due to the aforementioned problems, particulates are required to be removed from around the plunger and barrel seal area. Consequently, oil well pump production is often interrupted so that particulates may be removed in order to resume successful production of the oil well pump system. Based on the foregoing, there is a great need to overcome the aforementioned problems of clogged plungers that result from a build-up of particulates.

SUMMARY

Embodiments of the present disclosure generally provide a plunger apparatus including an upper cylindrical section, an elongated body, a lower cylindrical section, and a plurality of through-holes circumferentially arranged about the upper cylindrical section. An improved plunger upper threaded pin end may provide a relief area for particulates to be discharged from the plunger. Further, such a plunger apparatus does not compromise the structural loads sustained by the plunger.

A plunger apparatus may include an upper cylindrical section including a hollow interior. The upper cylindrical section may further include external threads disposed about each end of the upper cylindrical section. A plurality of through-holes may be circumferentially disposed about the upper cylindrical section. A leading edge may be configured at both an inward angle towards a central axis of the plunger apparatus and a downward angle towards a bottom of the plunger apparatus. The leading edge may be disposed so as to prevent particulates that enter a rod pump from blocking any portion of the plunger apparatus.

The plunger may include an undersized area circumferentially disposed about the upper cylindrical section including the plurality of through-holes. Further, the undersized area may create at least one point of relief and induce swirling of particulates. An oversized area may be circumferentially disposed about the upper cylindrical section above the undersized area and include a first shoulder. Further, the oversized area may create at least one point of increased pressure configured to urge particulates to find a path of least resistance in and away from the plurality of through-holes.

The foregoing summary is only intended to provide a brief introduction to selected features that are described in greater detail below in the detailed description. Other technical features may be readily apparent to one skilled in the art from the following drawings, descriptions and claims. As such, this summary is not intended to identify, represent, or highlight features believed to be key or essential to the claimed subject matter. Furthermore, this summary is not intended to be used as an aid in determining the scope of the claimed subject matter.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DETAILED DESCRIPTION

The present disclosure generally provides a plunger apparatus for a downhole rod pump. In the following description, for purposes of explanation, numerous specific details are set forth in order to provide a thorough understanding of the disclosed embodiments. It will become apparent, however, to one skilled in the art that various embodiments may be practiced without these specific details or with an equivalent arrangement.

Figures 1A, 1B, 1C:
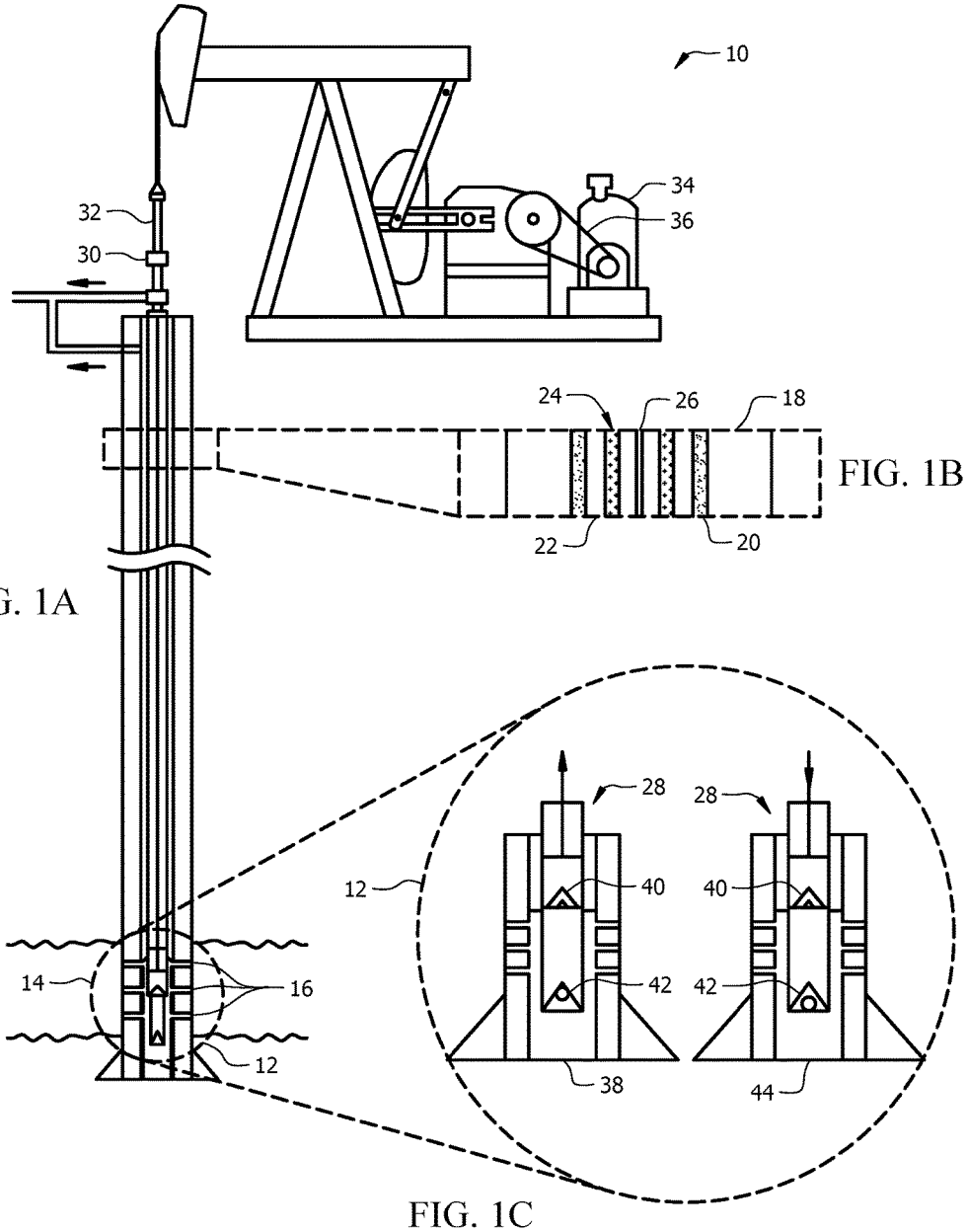
FIGS. 1A-1C are a schematic diagram of a producing oil well including downhole rod pump equipment according to a prior art pump system.

FIGS. 1A-1C depict a standard downhole rod pump assembly 10 in a producing oil well. See, Quinn Pumps Canada Ltd., *Reciprocating Pumps*, WWW.QUINNPUMPS.COM, http://www.quinnpumps.com/Recip_Pumps.html (last visited Jun. 18, 2015). Downhole pump 12 is arranged at the bottom of oil-bearing zone 14 where perforations 16 in cement 18 and casing 20 provide passages for oil reservoir fluid to travel into downhole pump 12. Casing 20 has a length as long as the oil well and includes annulus 22, tubing 24, and sucker rods 26. Sucker rods 26 are connected to plunger 28 and extend through stuffing box 30 and polished rod 32 and reciprocate plunger 28 due to a connection to prime mover 34 that transmits power to belt 36. During upstroke 38, sucker rods 26 and plunger 28 travel up the oil well while fluid flows up through traveling valve 40 that remains closed, while standing valve 42 remains open, to prevent fluid from flowing downward and out of plunger 28.

During downstroke 44, sucker rods 26 and plunger 28 travel down the oil well while the fluid flows down through traveling valve 40 that remains open, while standing valve 42 remains closed. While plunger 28 reciprocates inside of a cylinder or barrel during upstrokes 38 and downstrokes 44, fluid is forced out of oil-bearing zone 14 and into casing 20. However, particulates often become entrained with fluid and clog in the seal area along the shoulder edges of plunger 28. As such, when plunger 28 is clogged or loses its ability to seal, fluid cannot travel up casing 20 into downhole pump 12 to reach the surface of downhole rod pump assembly 10.

Figure 2:
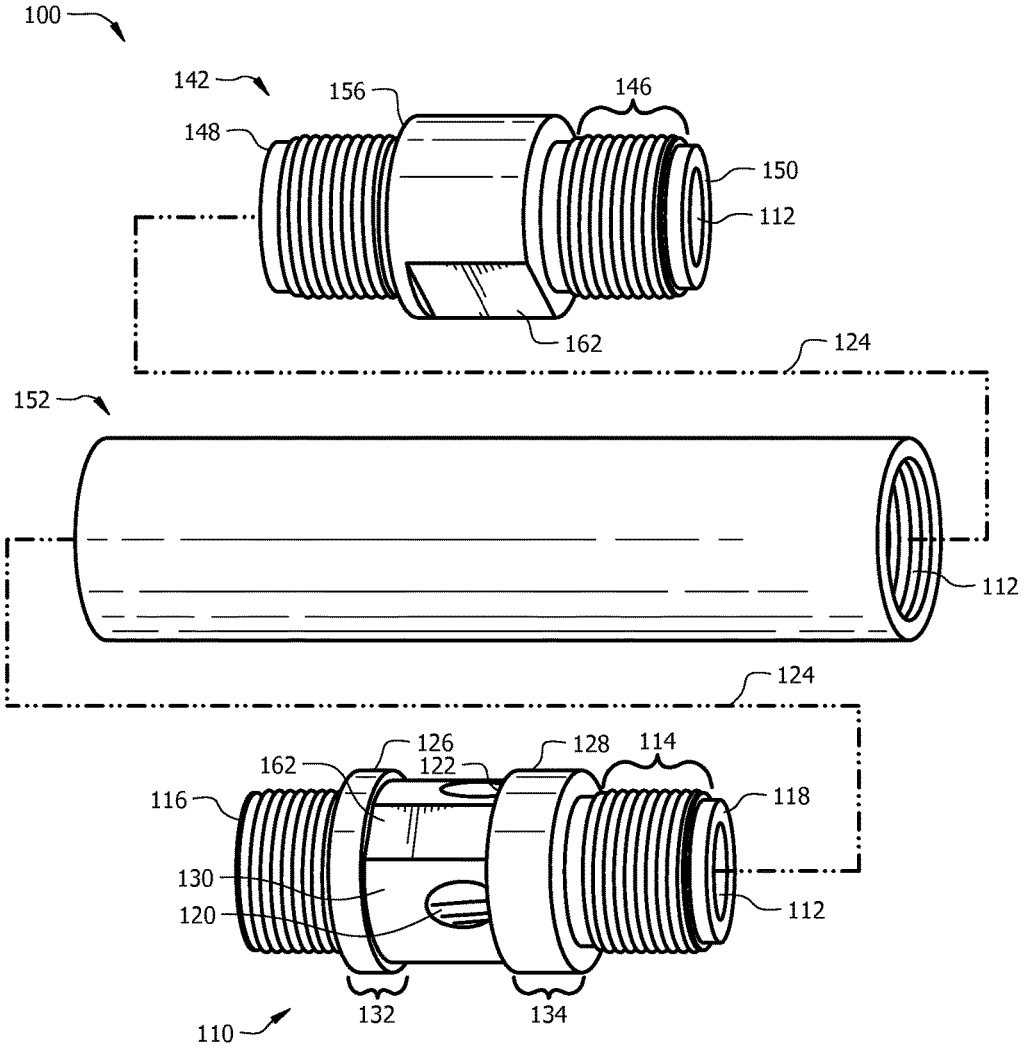
FIG. 2 depicts an exploded view of a plunger apparatus according to an embodiment of the present disclosure.
Figure 3:
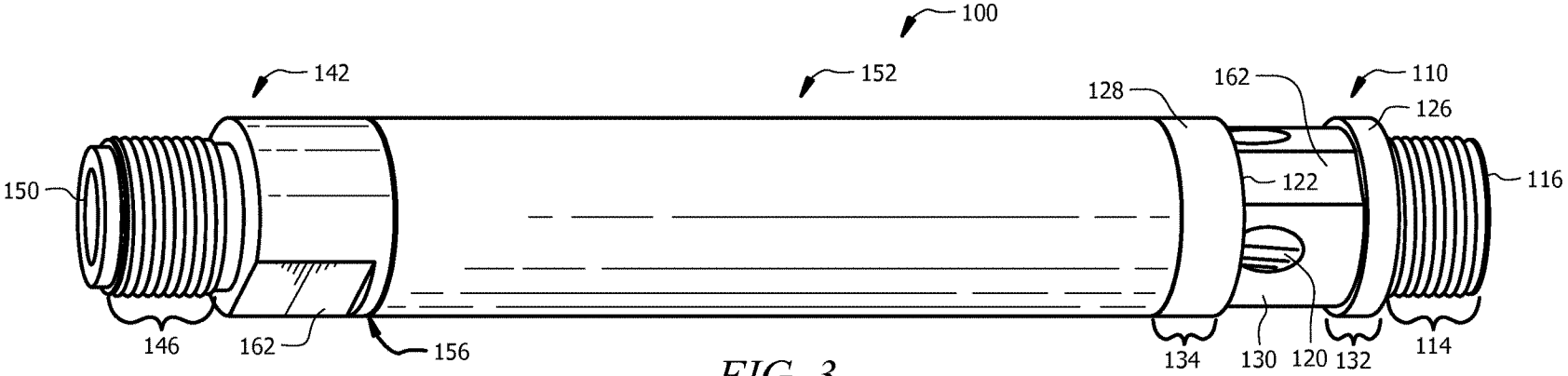
FIG. 3 depicts an assembled view of the plunger apparatus according to an embodiment of the present disclosure.
Figure 7:
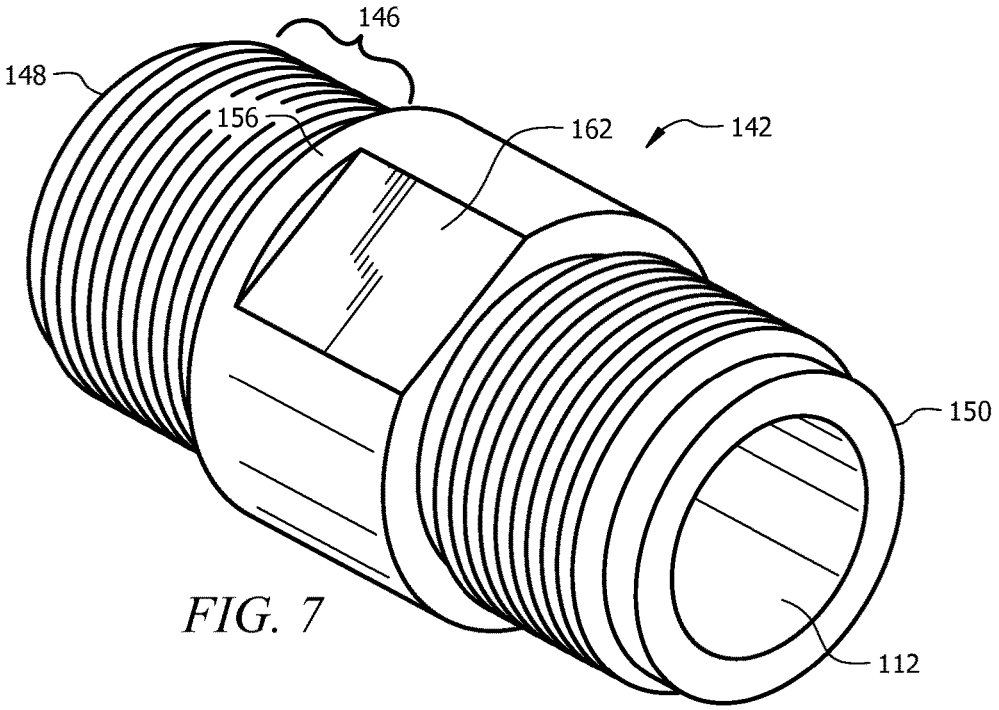
FIG. 7 depicts a perspective view of the plunger apparatus lower cylindrical section, as shown in FIGS. 1 and 2, according to an embodiment of the present disclosure.
Figure 8:
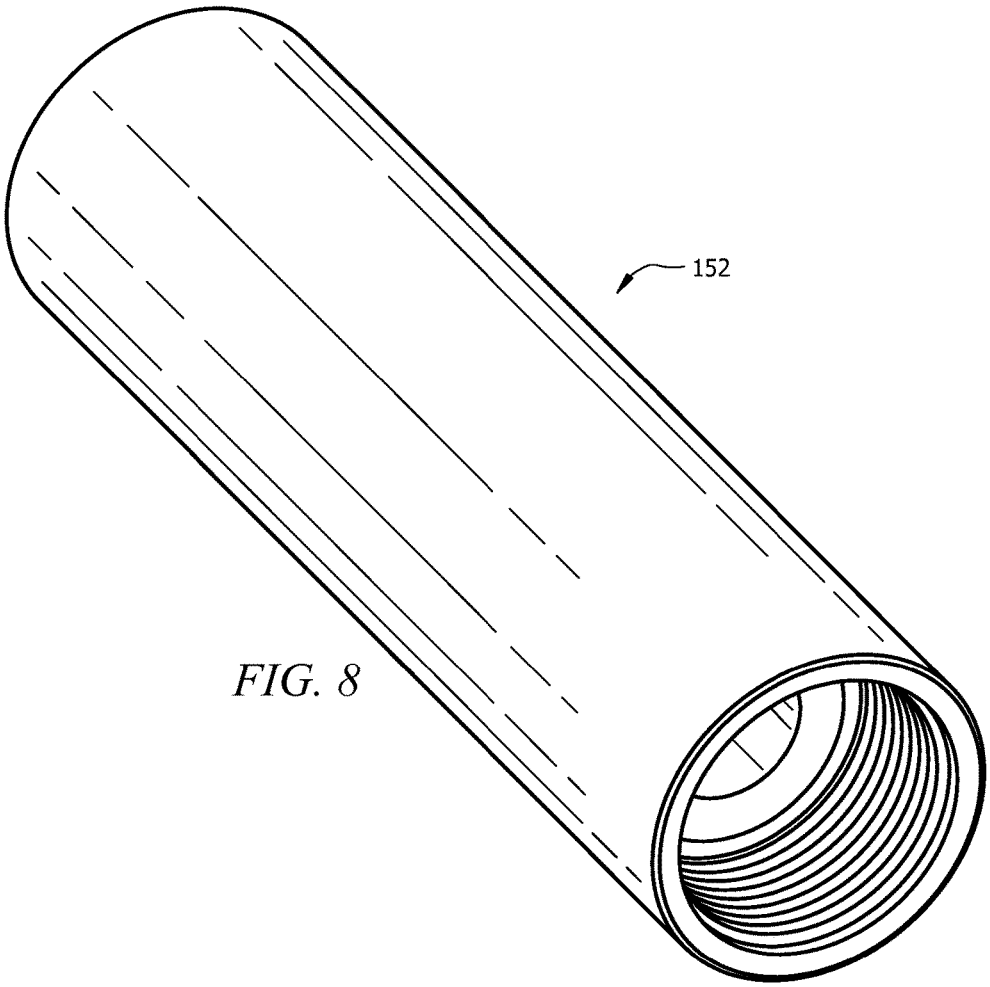
FIG. 8 depicts a perspective view of the plunger apparatus elongated body, as shown in FIGS. 1 and 2, according to an embodiment of the present disclosure.

According to an embodiment of the present disclosure, a plunger apparatus, such as plunger apparatus 100, may be modified to provide a relief area for particulates to be discharged from around the plunger apparatus so that all of the fluid forced out of an oil-bearing zone can reach the downhole pump and travel up to the surface of the downhole rod pump assembly. FIG. 2 depicts an exploded perspective view of plunger apparatus 100, according to an embodiment of the present disclosure. Plunger apparatus 100 may include upper cylindrical section 110, elongated body 152, and lower cylindrical section 142. Each of these three plunger sections 110, 152, and 142 may be easily separated and assembled via male threaded ends inside of elongated body 152, as shown in FIG. 8, and female ends outside of upper cylindrical section 110 and lower cylindrical section 142, as shown in FIGS. 6 and 7.

Figure 4:
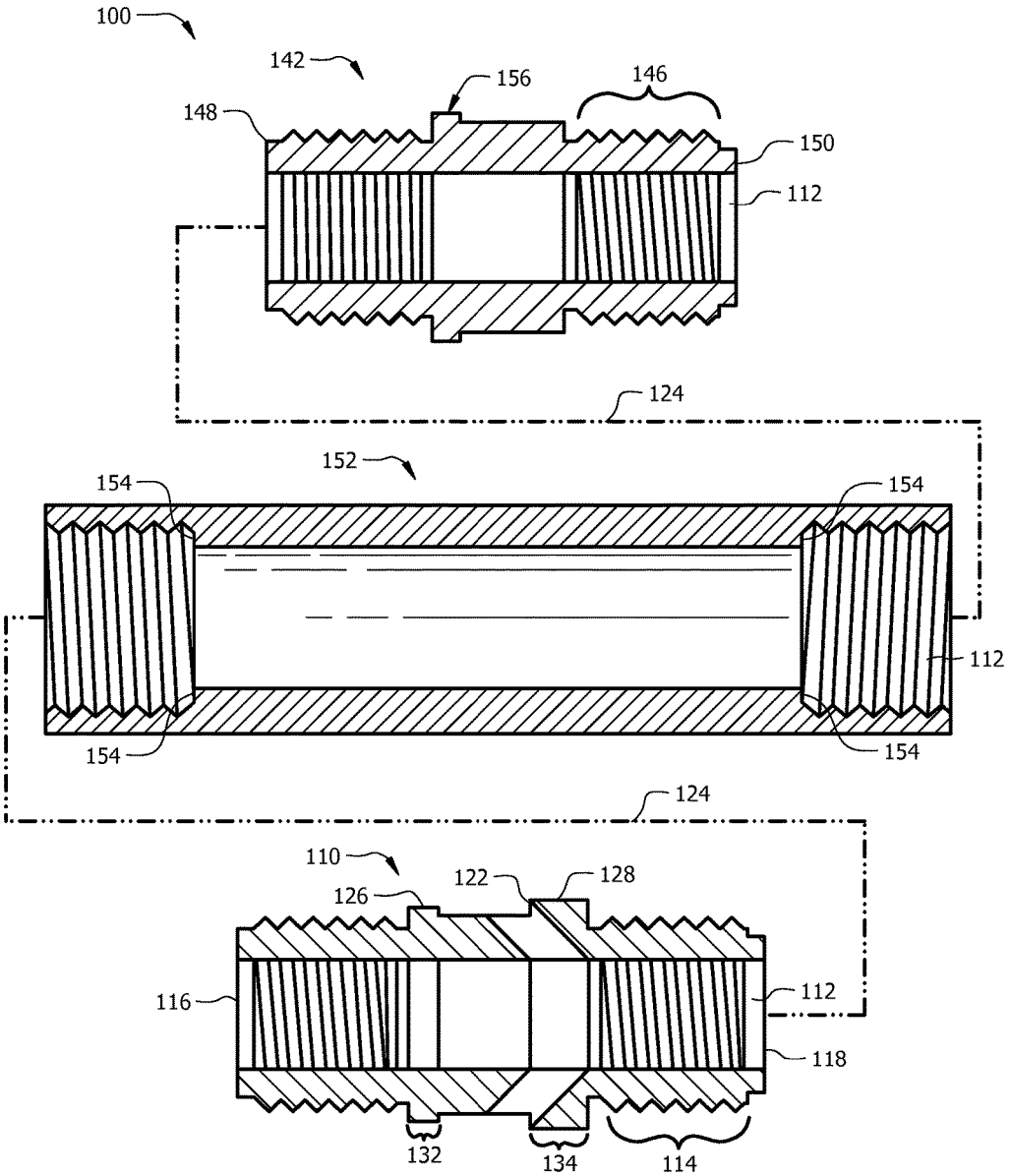
FIG. 4 depicts an exploded sectional view of the plunger apparatus, as shown in FIG. 2, according to an embodiment of the present disclosure.
Figure 6:
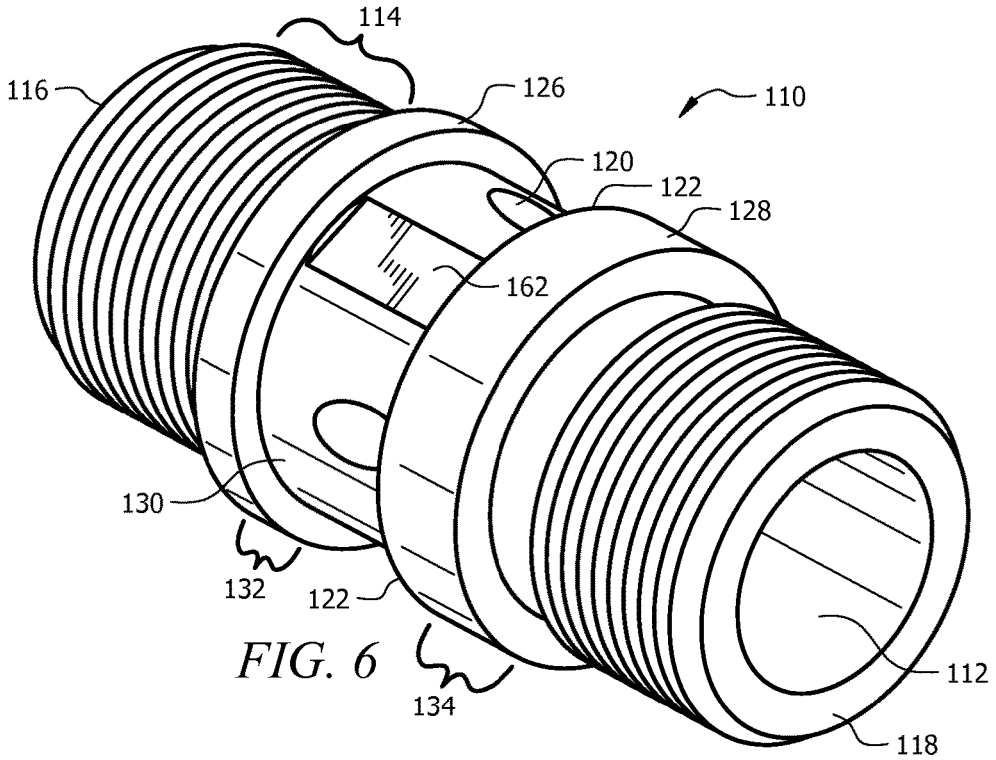
FIG. 6 depicts a perspective view of the plunger apparatus upper cylindrical section, as shown in FIGS. 1 and 2, according to an embodiment of the present disclosure.

According to an embodiment of the present disclosure, as shown in FIGS. 2, 4, and 6, upper cylindrical section 110 may include hollow interior 112, and external threads 114 circumferentially disposed about both female ends 116, 118. Further, hollow interior 112 of upper cylindrical section 110 may have a substantially smooth inner surface and form an upper part of a central passage of plunger apparatus 100. Similarly, as shown in FIGS. 2, 4, and 7, lower cylindrical section 142 may include hollow interior 112, and external threads 146 circumferentially disposed about both female ends 148, 150. Hollow interior 112 continues through elongated body 152 and lower cylindrical section 142 to form a central axis of plunger apparatus 100.

According to an embodiment of the present disclosure, the total length of plunger apparatus 100 may range from one to thirty feet. Further, in a non-limiting exemplary embodiment of the present disclosure, elongated body 152 may include external horizontal grooves (not shown) that may begin approximately four inches from leading edge 122 of plunger apparatus 100. The horizontal grooves may be disposed at intervals ranging between six and eight inches. Additionally, in a non-limiting exemplary embodiment of the present disclosure, elongated body 152 may have a base fit tolerance of ±0.005 inches between plunger apparatus 100 and an oil well pump barrel (not shown). It should be appreciated that the base fit tolerance may be adjusted depending on factors including, but not limited to, the viscosity of oil well fluids, the needs desired by users, and the location of the oil well.

Figure 9:
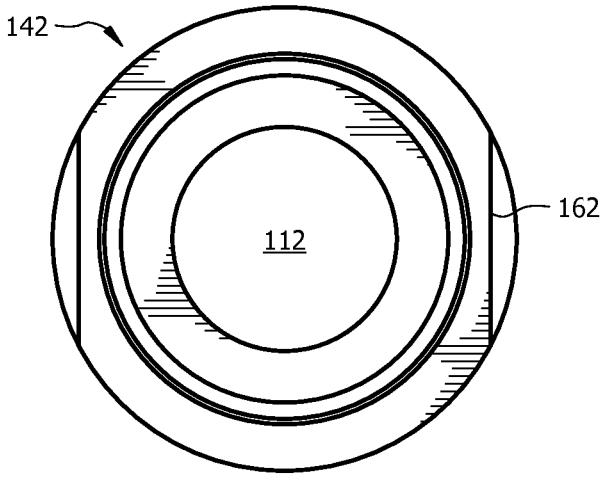
FIG. 9 depicts a bottom plan view of the plunger apparatus, according to an embodiment of the present disclosure.
Figure 10:
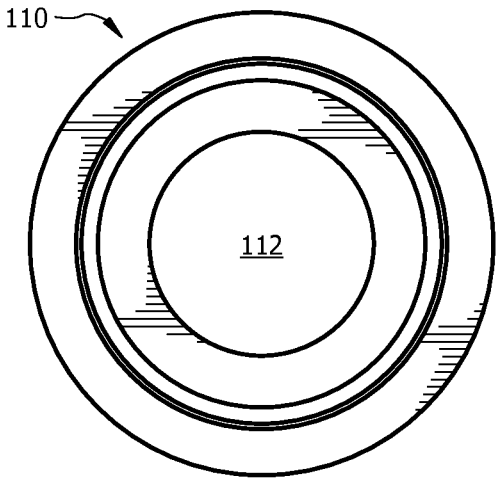
FIG. 10 depicts a top plan view of the plunger apparatus, according to an embodiment of the present disclosure.

While fitting flat 162 may not be required, it should be appreciated that in some embodiments of the present disclosure, as shown in FIGS. 2-3 and 5-6, at least one fitting flat 162 may be disposed along a section of upper cylindrical section 110, and at least one fitting flat 162 may be disposed along a section of lower cylindrical section 142 for engagement with tools, such as a wrench. It should be further be appreciated that two fitting flats are not required but may be disposed along a section of upper cylindrical section 110 and along a section of lower cylindrical section 142 in an embodiment of the present disclosure. As shown in FIG. 9, two fitting flats 162 may be disposed opposite one another about lower cylindrical section 142. As indicted by FIG. 10, fitting flats 162 may be disposed about upper cylindrical section 110 so that first shoulder 126 and second shoulder 128 extend past edges of fitting flats 162.

Referring to FIGS. 2-6, in a non-exemplary embodiment of the present disclosure, any number of through-holes 120 may be circumferentially disposed about a mid-section of upper cylindrical section 110. It should be appreciated that generally entire plunger apparatus 100 may be required to be replaced, however, it may be possible to replace parts of plunger apparatus 100 in some embodiments of the present disclosure. In an embodiment of the present disclosure, by being disposed about upper cylindrical section 110, plurality of through-holes 120 may be separated from elongated body 152 to perform service, maintenance, and/or replacement of plunger apparatus 100. In a non-limiting exemplary embodiment of the present disclosure, a quantity of three to eight through-holes 120 may be circumferentially disposed about a mid-section of upper cylindrical section 110. Further, the mid-section of upper cylindrical section 110 may be located between first shoulder 126 and second shoulder 128.

More specifically, as shown in FIGS. 2-6, in an embodiment of the present disclosure, through-holes 120 may be disposed so that the bottom of through-holes 120 are located within a portion of second shoulder 128. The remaining portions of plurality of through-holes 120 may be disposed directly above second shoulder 128. Each through-hole 120 may form a passage for venting or releasing fluid and particulates. According to an embodiment of the present disclosure, at least one through-hole 120 may be drilled at an angle upward and away from leading edge 122. In embodiments of the present disclosure, it should be appreciated that at least one through-hole 120 may be drilled at an angle downward and inward towards leading edge 122 without departing from the present disclosure. Further, in an embodiment of the present disclosure, two through-holes may be drilled an angle downward and inward towards leading edge 122, and two through-holes may be drilled at angle upward and away from leading edge 122. It should be appreciated that on a downstroke of plunger apparatus 100, fluid may flow up through the inside bore of plunger apparatus 100, and the fluid velocity may reach through-holes 120 that may be drilled upward and inward towards leading edge 122. As such, a vacuum or jetting action may be applied to an outside area of plunger apparatus 100 where solids may collect, thereby enhancing a fluid swirl and self-cleaning capability of plunger apparatus 100. In embodiments of the present disclosure, it should be appreciated that each through-hole 120 may be drilled at an angle greater than approximately 40 degrees and less than approximately 90 degrees to the horizontal. Further, in embodiments of the present disclosure, through-hole 120 may be drilled at angle between approximately 45° downward and inward to approximately 45° upward and inward towards leading edge 122. Further, according to an embodiment of the present disclosure, each through-hole 120 may have a diameter ranging from approximately ¼ inch to approximately ½ inch, depending on the outside diameter of plunger apparatus 100. The outside diameter of plunger apparatus 100 may range from approximately 1¼ inches to approximately 3¼ inches. According to an embodiment of the present disclosure, the clearance of the outer diameter of plunger apparatus 100 to the inner diameter of an oil well pump barrel (not shown) may range between 0.003 to 0.030 inches.

Figure 5:
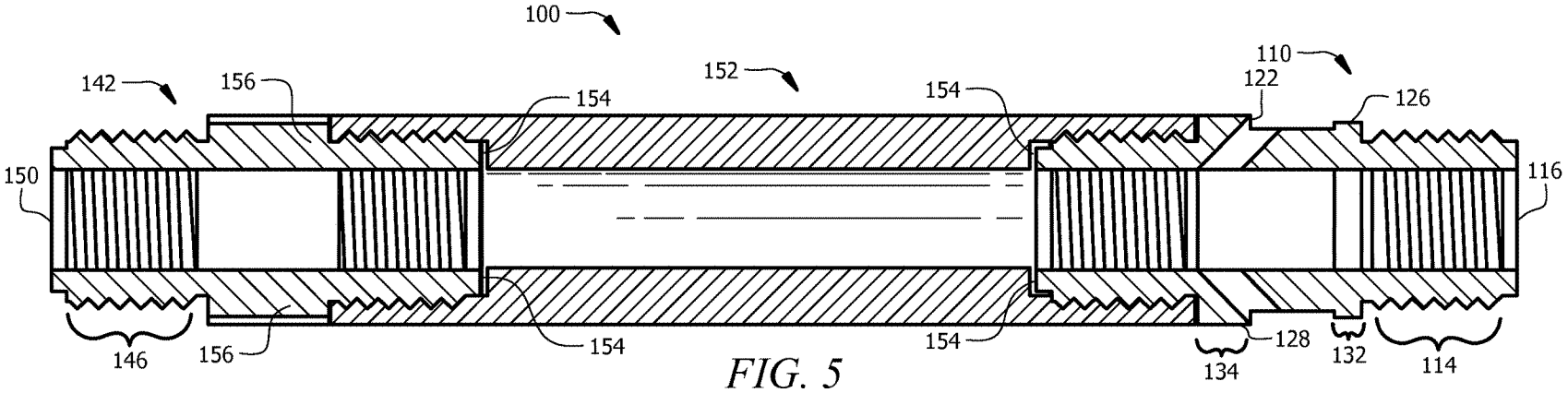
FIG. 5 depicts an assembled sectional view of the plunger apparatus, as shown in FIG. 3, according to an embodiment of the present disclosure.

According to an embodiment of the present disclosure, as shown in FIGS. 4 and 5, leading edge 122 of plunger apparatus 100 may be formed at an inward angle towards central axis 124 of plunger apparatus 100 and at a downward angle towards the bottom of plunger apparatus 100. Leading edge 122 may be cut at an angle ranging between approximately 45° to approximately 90° to the horizontal so that fluid exiting through-holes 120 may prevent plunger apparatus 100 from clogging. Further, leading edge 122 may be arranged so as to urge fluid and particulates to naturally flow off of second shoulder 128 away from plunger apparatus 100. Any build-up of particulates in and around through-holes 120 may also be swept away from plunger apparatus 100 and off of leading edge 122. Further, by arranging leading edge 122 at a 45° angle and through-holes at an angle ranging between approximately 45° downward and inward to approximately 45° upward and inward about upper cylindrical section 110, plunger apparatus 100 may not require a tapered shape or any other particular shape in order to prevent plunger apparatus 100 from clogging. As shown in FIGS. 4 and 5, simultaneous torque may be received on both second shoulder 128 of upper cylindrical section 110 and shoulder 156 of lower cylindrical section 142. The simultaneous torque onto elongated body 152 may create seal and torque areas 154. It should be appreciated that seal and torque areas 154 may form an internal seal inside of elongated body 152.

In a non-limiting exemplary embodiment of the present disclosure, through-holes 120, may be disposed about upper cylindrical section 110 so that the majority, if not all, particulates, such as fines and debris, may be discharged from and cleaned out of plunger apparatus 100. Consequently, plunger apparatus 100 may be prevented from experiencing a build-up of particulates that enter the rod pump. Further, through-holes 120 may be disposed about upper cylindrical section 110, so as to sweep particulates back into a fluid solution and carried out of a well. By having a vertical orientation slanted inward towards central axis 124 of plunger apparatus 100, through-holes 120 are arranged to naturally release particulates entrained with fluid. Therefore, plunger apparatus 100 may prevent solids entrained with fluid from wedging into leading edge 122 of plunger apparatus 100 during an upstroke of plunger apparatus 100.

According to an embodiment of the present disclosure, undersized area 130 may be circumferentially disposed about upper cylindrical section 110 including plurality of through-holes 120. Undersized area 130 may create at least one point of relief and induce swirling of particulates to prevent solids in fluid from wedging into leading edge 122 during an upstroke of plunger apparatus 100. During an upstroke, plunger apparatus 100 may reciprocate using an upward motion and closing an internal valve (not shown) at the bottom of plunger apparatus 100. Further, as particulates become entrained in fluid, undersized area 130 may reduce the settling of particulates in fluids. In a non-limiting exemplary embodiment of the present disclosure, undersized area 130 may have a tolerance of approximately ±0.050 inches between plunger apparatus 100 and an oil well pump barrel (not shown). It should be appreciated that the base fit tolerance may be adjusted depending on factors including, but not limited to, the viscosity of oil well fluids, the needs desired by users, and the location of the oil well.

According to an embodiment of the present disclosure, oversized area 132 may include first shoulder 126. Further, oversized area 132 may be circumferentially disposed about upper cylindrical section 110 and above undersized area 130. Oversized area 132 may create at least one point of increased pressure in an area proximate plurality of through-holes 120. In a non-limiting exemplary embodiment of the present disclosure, oversized area 132 may have a tolerance of approximately ±0.050 inches.

In an embodiment of the present disclosure, first shoulder 126 may be circumferentially disposed about upper cylindrical section 110. Second shoulder 128 may also be circumferentially disposed about upper cylindrical section 110 below first shoulder 126. By locking into elongated body 152 via internal threads inside of elongated body 152, second shoulder 128 seals plunger apparatus 100 and prevents liquids and other material from escaping out of plunger apparatus 100. In an embodiment of the present disclosure, second width 134 may, but is not required, to be included. It should be appreciated that second shoulder 128 may include portions of plurality of through-hole passages and may have second width 134 smaller than first width or oversized area 132 of first shoulder 126. It should further be appreciated that second width 134 of second shoulder 128 may be half of first width or oversized area 132 of first shoulder 126. In a non-limiting exemplary embodiment of the present disclosure, second shoulder 128 may have simultaneous torque with threads 114 of upper cylindrical section 110.

According to an embodiment of the present disclosure, plunger apparatus 100 may be used in a downhole reciprocating rod pump with bore sizes including, but not limited to, 1¼ inches, 1½ inches, 1¾ inches, 2 inches, 2¼ inches, 2¾ inches, and 3¼ inches. Plunger apparatus 100 may be made of multiple materials depending on the desired properties. Some examples may include, but are not limited to, metals, such as, nickel alloy, steel, stainless steel, bronze, brass, and iron. According to an embodiment of the present disclosure, plunger apparatus 100 may include a coating selected from multiple materials including, but not limited to, an alloy and a composite. Further, according to an embodiment of the present disclosure, an appropriate hardness may be selected for plunger apparatus 100.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

The invention claimed is:

1. A plunger apparatus comprising:

a lower cylindrical section including a hollow interior, wherein external threads are disposed about each end of the lower cylindrical section; and an elongated body disposed between an upper cylindrical section and the lower cylindrical section, the elongated body including a hollow interior and internal threads configured to receive the upper cylindrical section at a top end of the elongated body and the lower cylindrical section at a bottom end of the elongated body, the upper cylindrical section comprising:

a hollow interior;

external threads disposed about each end of the upper cylindrical section;

a plurality of multidirectional through-holes circumferentially arranged about the upper cylindrical section;

a leading edge configured at both an inward angle towards a central axis of the plunger apparatus and a downward angle towards a bottom of the plunger apparatus, wherein the leading edge is disposed so as to prevent particulates entering a rod pump from restricting travel, causing damage to or blocking any portion of the plunger apparatus;

an undersized area circumferentially disposed about the upper cylindrical section including the plurality of through-holes, wherein the undersized area creates at least one point of relief and induces swirling of particulates; and an oversized area circumferentially disposed about the upper cylindrical section above the undersized area and including a first shoulder, wherein the oversized area creates at least one point of increased pressure configured to urge particulates away from the leading edge of the elongated body using the plurality of multidirectional through-holes, wherein the first shoulder is circumferentially disposed about the upper cylindrical section; and the upper cylindrical section further comprising:

a second shoulder circumferentially disposed about the upper cylindrical section below the first shoulder, wherein the second shoulder includes portions of the plurality of through-holes and a second width from the outer diameter of the upper cylindrical section to an outer edge of the second shoulder smaller than a first width from the outer diameter of a base of the external threads to an outer edge of the first shoulder.

2. The apparatus of claim 1, wherein the elongated body is comprised of nickel alloy.

3. The apparatus of claim 1, wherein each of the plurality of multidirectional through-holes has a diameter ranging from one-fourth of an inch to one-half of an inch, and wherein the plunger apparatus has a diameter ranging from one and one-fourth inches to three and one-fourth inches.

4. The apparatus of claim 1, wherein each of the plurality of multidirectional through-holes is angled within a range between approximately 45 degrees downward and inward towards the leading edge and approximately 45 degrees upward and inward towards the leading edge.

5. An upper plunger pin apparatus, comprising:

a plurality of multidirectional through-holes circumferentially arranged about the upper plunger pin apparatus;

a shoulder having a leading edge disposed so as to prevent particulates entering a rod pump from restricting travel, causing damage to or blocking any portion of the plunger apparatus;

an undersized area circumferentially disposed about the upper plunger pin apparatus to create at least one point of relief and induce swirling of particulates; and an oversized area circumferentially disposed about the upper plunger pin apparatus to create at least one point of increased pressure and urge particulates away from the leading edge using the plurality of multidirectional through-holes, wherein the upper plunger pin apparatus threadedly connects to an elongated body, the elongated body having dual seal and torque edges at an outer end and on an inside thread.

6. The apparatus of claim 5, wherein the shoulder includes portions of the plurality of through-holes.

7. The apparatus of claim 5, wherein each of the plurality of multidirectional through-holes has a diameter ranging from one-fourth of an inch to one-half of an inch.

8. The apparatus of claim 5, wherein each of the plurality of multidirectional through-holes is angled at a range between approximately 45 degrees downward and inward towards the leading edge and approximately 45 degrees upward and inward towards the leading edge.

9. The apparatus of claim 5, further comprising:

at least one fitting flat circumferentially arranged about the upper plunger pin between two of the plurality of multidirectional through-holes.

10. The apparatus of claim 5, wherein the elongated body is comprised of nickel alloy.

11. A downhole rod pump assembly, comprising:

a plunger having a plurality of multidirectional through-holes circumferentially arranged about an upper section of the plunger;

a leading edge arranged at the upper section of the plunger, wherein the leading edge prevents particulates entering the downhole rod pump assembly from restricting travel, causing damage to or blocking any portion of the plunger;

an undersized area arranged along the upper section of the plunger, wherein the undersized area creates at least one point of relief and induces swirling of particulates;

an elongated body that threadedly connects to the upper section of the plunger, the elongated body having dual seal and torque edges at an outer end and on an inside thread; and an oversized area arranged along the upper section of the plunger, wherein the oversized area creates at least one point of increased pressure and urges particulates away from the leading edge using the plurality of multidirectional through-holes.

* * * * *